US006339921B1

(12) United States Patent
Lassmann et al.

(10) Patent No.: US 6,339,921 B1
(45) Date of Patent: Jan. 22, 2002

(54) TEXTILE YARN PIECING DEVICE WITH AN EVALUATION ARRANGEMENT FOR DETERMINING PARAMETERS OF AN AUTOMATIC YARN PIECING PROCESS

(75) Inventors: Manfred Lassmann, Nettetal; Heribert Mertens, Willich, both of (DE)

(73) Assignee: W. Schlafhorst AG & Co. (DE)

( * ) Notice: Subject to any disclaimer, the term of this patent is extended or adjusted under 35 U.S.C. 154(b) by 0 days.

(21) Appl. No.: 09/716,798

(22) Filed: Nov. 20, 2000

(30) Foreign Application Priority Data

Nov. 19, 1999 (DE) ..... 199 55 674

(51) Int. Cl.[7] ..... D01H 13/26

(52) U.S. Cl. ..... 57/264; 57/22; 57/23; 57/261; 57/262; 57/263; 57/265; 57/400; 57/404; 57/405

(58) Field of Search ..... 57/27, 23, 261, 57/262, 263, 264, 265, 400, 404, 405; 19/239, 240

(56) References Cited

U.S. PATENT DOCUMENTS

| | | | | |
|---|---|---|---|---|
| 4,712,367 A | * | 12/1987 | Lassmann | 57/263 |
| 4,825,632 A | * | 5/1989 | Raasch et al. | 57/264 |
| 5,832,709 A | | 11/1998 | Lassmann et al. | 57/263 |
| 6,035,622 A | | 3/2000 | Fox et al. | 57/263 |

FOREIGN PATENT DOCUMENTS

| | | |
|---|---|---|
| DE | 34 40 009 C2 | 12/1987 |
| DE | 37 16 728 A1 | 5/1989 |
| DE | 196 49 329 A1 | 6/1997 |
| DE | 40 30 100 A1 | 3/2000 |

OTHER PUBLICATIONS

Raasch et al German Publication entitled "Automatisches Anspinnen beim OE–Rotorspninen" (Automatic Piecing in Open–End Rotor Spinning), Melliand Textilberichte (Textile Reports); Mar. 1989, pp. 251 to 256.
German Search Report.

* cited by examiner

*Primary Examiner*—John J. Calvert
*Assistant Examiner*—Shaun R. Hurley
(74) *Attorney, Agent, or Firm*—Kennedy Covington Lobdell & Hickman, LLP

(57) ABSTRACT

A piecing device with an evaluation arrangement for determining parameters of an automatic piecing process at a spinning station (1) of an open-end spinning frame, wherein a control device is provided which, initially in a test phase, controls the creation of at least one test piecing without a supplementary delivery of additional fiber and the subsequent removal of the created test piecing. The evaluation device is designed for determining the length of a thinner extent of the test piecing downstream of the test piecing as viewed in the direction of yarn travel, and for the determination from the detected length of the thinner extent an amount of supplementary delivery of additional fiber required for compensating the thinner extent. A reduction of the draft which is effective during the test phase assures an interference-free checking of the test piecing. The optimization phase for piecings is shortened and leads to a more accurate result when determining the supplementary delivery of additional fiber.

7 Claims, 5 Drawing Sheets

TEXTILE YARN PIECING DEVICE WITH AN EVALUATION ARRANGEMENT FOR DETERMINING PARAMETERS OF AN AUTOMATIC YARN PIECING PROCESS

CROSS-REFERENCES TO RELATED APPLICATIONS

This application claims the benefit of German patent application DE P 19955674.1 filed Nov. 19, 1999, herein incorporated by reference.

FIELD OF THE INVENTION

The present invention relates to a textile yarn piecing device with an evaluation arrangement for determining parameters of an automatic yarn piecing process, and more particularly to such a piecing device having at least one sensor device for measuring the yarn diameter and for detecting the position of a respective measuring point in relation to the yarn piecing created.

BACKGROUND OF THE INVENTION

As demands have been increasingly made on the yarn production process, continuously higher demands are being made on the creation of yarn piecings formed in the yarn production process. Following yarn breaks, the process of creating piecings and the subsequent re-start of the spinning process is usually performed at the individual spinning stations of the open-end rotor spinning frames by a piecing device, often referred to as a piecing cart, which travels along the spinning frames.

For example, following a yarn break, which triggers the piecing process, the time before spinning is re-started again at the spinning station is of varying length. The delivery of sliver is deactuated when the yarn break occurs. However, the opening roller continues running and continues to separate fibers from the sliver previously fed. In order to produce uniform conditions for the spinning re-start, the fiber feed from the sliver is equalized before every spinning start to achieve as uniform as possible a pre-feeding amount of sliver. Spinning starts with the start of rotation of the rotor. A control device, for example a microprocessor, calculates the acceleration required for the rotor to reach operating speed from pulses detected as a function of the number of rotor revolutions, so that a preset number of revolutions of the rotor for the spinning start is reached after a constant amount of time, and determines the time of starting the pre-feeding of sliver based upon the acceleration. Fibers are again combed out of the sliver and are aspirated over the edge of the stopped rotor during the time following the equalization of the fiber presented from the sliver and the time of re-actuation of the delivery device for the operational fiber feed. This causes a certain delay in achieving the required fiber flow and possibly a thinner extent of yarn downstream of the yarn piecing during the acceleration of the fiber delivery device to its delivery speed. Pre-feeding of fiber takes place during a predetermined time and is deactuated thereafter. In the course thereof, it is also possible to control the amount of delivered fibers by setting the delivery speed, besides the length of pre-feeding. Following the deactuation of fiber pre-feeding and the return of the trailing end of the broken yarn, i.e., the so-called upper yarn, the fiber delivery is turned on again shortly prior to the start of the fiber withdrawal in order to compensate for the delay. The amount of fibers now fed into the rotor is placed on top of the previously delivered amount of fibers in the rotor. Starting of the fiber withdrawal takes place after a defined amount of dwell time of the yarn in the rotor groove, during which the end of the upper yarn to be connected has time to break open the ring of fibers in the rotor and to become connected with the delivered fibers. The yarn withdrawal speed is set to a value corresponding to the instantaneous number of rotor revolutions while maintaining the desired yarn twist. Up to the point at which the operating number of rotor revolutions is achieved, the yarn withdrawal speed follows the increase in the number of rotor revolutions. Besides the continued running of the fiber flow after the delivery has been deactuated, and the delayed actuation of the delivery, the flow of fibers can also react with a delay during the increase of the delivery speed. This can lead to the yarn becoming too thin while the rotor is being accelerated. In particular, this occurs distinctively at low delivery speeds.

To prevent this undesired deviation from the desired yarn thickness, it is possible to perform a supplementary delivery of additional fiber. In the course thereof, the delivery speed of the fiber feed device is increased over a set value in order that the respectively required amount of fibers arrives in the rotor. A thinner extent in the yarn can also still occur even with the performance of a supplementary delivery of additional fiber, if the latter is performed to an insufficient extent. If the supplementary delivery of additional fiber is of too large a size, a thick place is caused in the yarn, which is also undesired. Efforts are therefore made to make the amount of the supplementary delivery of additional fiber as accurate as possible from the start. With the increasing feed path of the sliver, the addition is reduced. The supplementary delivery of additional fiber is terminated after a delivery length, which corresponds to the staple length, has been achieved. Starting at this time, the amount of fiber is delivered without any supplementary delivery of additional fiber. Such supplementary delivery of additional fiber during the start of spinning have been described, for example, in German Patent Publication DE 40 30 100 A1, or in the publication by Raasch et al., entitled: "Automatisches Anspinnen beim OE-Rotorspinnen" [Automatic Piecing in Open-End Rotor Spinning], in MELLIAND Textilberichte [Textile Reports], April/1989, pp. 251 to 256.

The demands made on the accuracy of the lengths of such additional deliveries of fiber have been noticeably increased because of the increasing requirements made on yarn quality, and in particular with the demands for greater spin drafting and smaller rotors. With a draft of 100 times, an error of 0.5 mm in determining the length of the supplementary delivery of additional fiber causes an error in relation to the yarn of 50 mm in length. With 350-times the draft, this error affects a length of 175 mm of the yarn. These examples clearly illustrate how great the demands made on accuracy are when determining the length of a supplementary delivery of additional fiber.

In accordance with the above mentioned prior art, the first piecing is already created with a supplementary delivery of additional fiber. In this manner, it is intended to prevent thinner extents, along with the danger of yarn breaks and interruptions during the spinning start connected with this supplementary delivery of additional fiber. To determine the supplementary delivery of additional fiber, an empirical value is employed, which is a function of the average staple length of the fibers used. While the staple length of synthetic yarn is known, the staple length of cotton or mixed yarns can only be determined with sufficient accuracy by means of extensive laboratory tests. Since the staple length is proportionally a part of the determination of the length of the supplementary delivery of additional fiber, deviations between the staple length used for the calculations and the actual staple length lead to errors in the determination of the length of the supplementary delivery of additional fiber, which has the above described results and in particular have a special effect in case of long drafts.

Further criteria, for example the clothing of the opening roller, the number of revolutions of the opening roller and the rotor acceleration time (with its effects on the comb-out time), have an effect on the required extent of the supplementary delivery of additional fiber. However, this effect can only be determined empirically, by means of generating and evaluating a large number of further piecings. Thus, a sufficiently exact size of the supplementary delivery of additional fiber for a qualitatively satisfactory piecing can only be determined following a relatively elaborate, and in particular time-consuming, optimization phase. The optimization requires the manual intervention of the operators. The quality of the results is definitely dependent on the experience of the operators.

OBJECT AND SUMMARY OF THE INVENTION

It is accordingly an object of the present invention to provide improvements in the creation of a yarn piecing.

In accordance with the invention, this object is attained by means of a piecing device equipped with a control device which is operative to perform a testing phase during which at least one test piecing is created without any supplementary delivery of additional fiber. The length of a thinner extent created downstream of the test piecing (as viewed in the traveling direction of the yarn) is determined and the extent of the supplementary delivery of additional fiber is determined from the measured length of the thinner extent. In this manner, it is possible to obtain high-quality piecings immediately following the start of the spinning operation by means of a single setting of piecing parameters in the test phase, which are distinguished by the greatest possible matching of the upper yarn diameter and the diameter of the newly spun yarn section adjoining the piecing.

It has been surprisingly shown that the optimization phase in connection with the creation of yarn piecings is not lengthened by the additional testing phase creating test piecings, but is clearly shortened. In this manner, the supplementary delivery of additional fiber can be very precisely determined.

The above mentioned prior art demonstrates that, by the employment of empirical values in connection with piecing parameters, an attempt is made to already prevent thinner extents when creating the first piecing, or at least to reduce such thinner extents, and to make the yarn uniform in the area of piecing. This is intended to prevent interruptions and to increase productivity. The piecing optimization is not only clearly accelerated by means of creating a test piecing in a test phase and the subsequent removal of the test piecing as contemplated by the present invention, but in addition the yarn produced in the course of the spinning operation already exclusively contains high grade piecings and therefore is of an increased yarn quality from the start. Also, the degree of automation of the automatic piecing operation can be increased with an embodiment in accordance with the present invention. The operators are thereby relieved so as to be available for other jobs.

The size of the supplementary delivery of additional fiber is a function of the length of the supplementary delivery of additional fiber. The length of the thinner extent, which is used to draw conclusions regarding the length of the supplementary delivery of additional fiber, can be determined by the evaluation of the measured yarn diameters. For this purpose, the yarn diameters measured in the area of the thinner extent can be compared with a reference diameter derived from the diameter of the upper yarn, and the end of the thinner extent, and accordingly the length thereof, can be determined when a match has been detected. The comparison can be performed by means of a comparator. It is alternatively possible to determine the mean rise of the curve path in the end area of the thinner extent by the course of the diameter determined by means of the measured diameter values and represented as a curve path plotted over the yarn length, and the intersection of the mean rise and the comparison diameter derived from the upper thread diameter can be determined to be the termination of the thinner extent.

By means of a reduction of the draft effective during the test phase it is possible to prevent the thinner extent downstream of the test piecing becoming so thin as to present a risk of a yarn break and therefore to prevent the case where a measurable test piecing, or a measurably thinner extent would no longer be available. The draft reduction in addition makes it possible that, even with large drafts, the yarn assuredly assumes or reaches the comparison diameter derived from the standard yarn thickness within a limited window for piecing check measurement, and that therefore the measurement of the thinner extent can take place in every case.

An algorithm, which takes into consideration the staple length and a limited, preselected measurement range for measuring the yarn diameter, advantageously permit the simple, rapid and automated determination of the minimum size of the draft reduction. For this purpose, the staple length can also be determined only approximately without disadvantageous results. To this end, the parameters can be previously provided to the control device or a computer installation connected with the control device, or the parameters can be called up out of a data memory.

In case of nominal drafts, for example wherein the draft lies between fifty times and one hundred times and wherein the algorithm taking the staple length and the limited measurement area for measuring the yarn diameter into consideration does not result in any draft reduction or in just a slight draft reduction, it is possible to determine the reduced draft in a simplified way by multiplying the nominal draft with a preselected factor which is slightly less than one.

An increase in the precision of the result of the evaluation is achieved if several test piecings with the same preselected parameters are checked, and if a mean profile for the piecings of thinner extent is formed from this evaluation thereafter or continuously. Natural fluctuations in the sliver or the fiber mixture, as well as scattering caused by the differences in the spinning means, are thereby included in the evaluation. It is simultaneously possible by means of averaging to produce a smoothing of the piecing profiles, whereby the measurement of the thinner extents can take place more easily, precisely and dependably. For this purpose, the test piecings can be created at several different spinning stations.

The increased demands on accuracy made with increasing nominal drafts in the course of the determination of the supplementary delivery of additional fiber, and therefore on the precision of the piecing profile, are taken into account in that the number of test piecings used for forming the mean values is also increased with a rise in the nominal draft.

A check of the automatic evaluation of piecing profiles can be advantageously performed in the testing phase by means of a device for displaying of the piecing profiles, for example as the piecing repetitions occur, or during the deactuation of spinning stations during piecing.

By means of the present invention, it is possible to significantly reduce the optimization phase when creating piecings, and to improve the piecing profile. The invention represents a step in the direction toward an automatic service device, for example a piecing cart, which calibrates and optimizes itself on the basis of the quality data determined by the piecing checking device. By means of the invention, it is possible to advantageously increase productivity, and therefore also the efficiency of the yarn production process, as well as the yarn quality.

Further details, features and advantages of the invention will be explained and understood from the following disclosure of a preferred embodiment of the invention with reference to the illustrations in the accompanying drawing figures.

DETAILED DESCRIPTION OF THE PREFERRED EMBODIMENT

Figure 1:
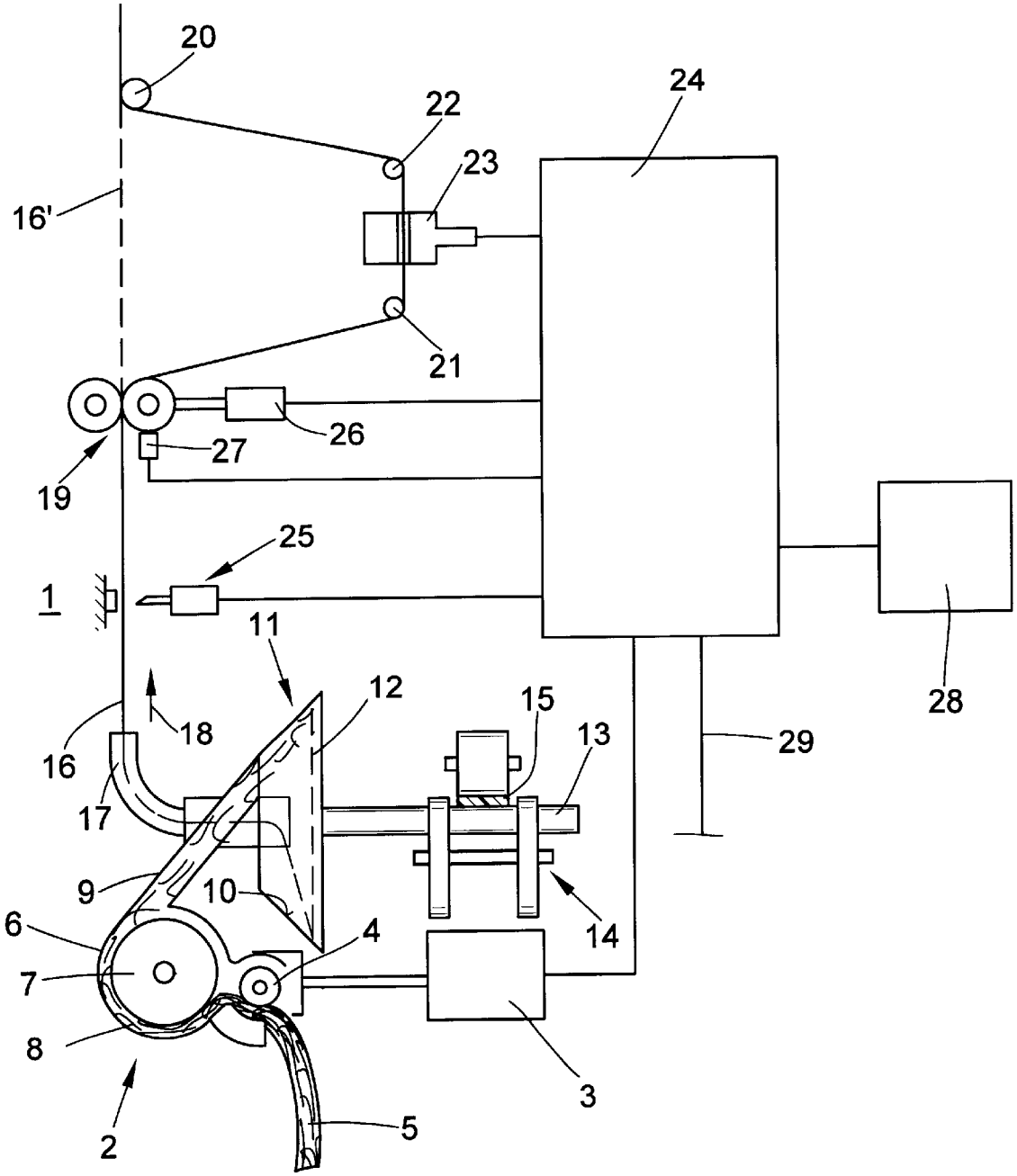
FIG. 1 is a simplified schematic representation of a spinning station of an open-end rotor spinning frame in which the present invention is embodied.

The exemplary embodiment in FIG. 1 shows a spinning station 1 of a multi-station open-end rotor spinning frame. The spinning station 1 has an opening arrangement 2, into which a sliver 5 is introduced by means of a delivery roller 4 driven by a continuously controllable electric motor 3. The sliver 5 is presented to an opening roller 7 rotating in the housing 6, which opens the delivered sliver 5 into individual fibers 8. The individual fibers 8 are delivered onto the conical annular sliding surface 10 of the spinning rotor 11 through the fiber guide conduit 9, and progress therefrom into the peripheral fiber collecting groove 12. The rotor 11 is fastened on a shaft 13, which is seated in a rotor disk bearing 14 and is driven by means of a tangential belt 15. The yarn 16 is formed in the fiber collecting groove 12 and is drawn off by means of a withdrawal arrangement 19 through the yarn withdrawal tube 17 in the direction of the arrow 18.

The withdrawal arrangement 19 has a pair of rollers. In normal spinning operations, the yarn 16' follows the dashed line downstream from the withdrawal arrangement 19 and is continuously wound onto a cheese (not represented). A yarn piecing device capable of traveling along the spinning machine is provided for performing piecing operations, and is positioned at the respective spinning stations requiring the performance of the piecing process. The piecing device, embodied as a piecing cart, is not represented in detail in the drawings.

A test is performed at the end of a piecing operation to determine whether piecing was properly performed. To this end, the yarn 16 is diverted for a distance into the piecing cart, which is schematically indicated by the yarn deflection between the withdrawal arrangement 19 and a yarn guide 20. In the piecing cart (not represented in detail), the yarn 16 extends between two yarn guides 21 and 22 in front of a sensor device 23 with which the yarn profile is measured.

During the test, signals regarding the yarn profile measuring values for the diverted yarn length are fed to a control device 24. If it is determined that preset threshold values have been exceeded, the conclusion is drawn that this represents a defect in the yarn profile which cannot be tolerated. A cutting signal is triggered and transmitted to a cutting device 25, which cuts the yarn 16. This break in the yarn 16 is detected no later than when the yarn is no longer detected in front of the sensor device 23, whereupon an error signal triggers a fresh piecing process.

Checking of the yarn profile takes place on the accelerating yarn. Specifically, following a piecing operation, the yarn is drawn out of the yarn withdrawal tube 17 by the withdrawal arrangement 19 at an increasing speed, which corresponds to the increasing number of revolutions of the accelerating rotor. A sensor 27 detects pulses from the yarn withdrawal roller driven by a drive mechanism 26 of the withdrawal arrangement 19, so that the measuring frequency of the sensor device 23 can be set to the changing speed of the accelerated yarn 16. These pulses provide information regarding the withdrawal speed of the yarn 16. The sensor signals are transmitted to the control device 24, which controls the measuring frequency of the sensor 27 and matches it to the yarn withdrawal speed. The control device 24 is connected with a device 28 for displaying the piecing profile, and via the line 29 with further modules of the spinning frame.

Further details of such spinning frames can be obtained, for example, from German Patent Publication DE 40 30 100 A1, or the publication by Raasch et al., entitled: "Automatisches Anspinnen beim OE-Rotorspinnen" [Automatic Piecing in Open-End Rotor Spinning], in MELLIAND Textilberichte [Textile Reports], April/1989, pp. 251 to 256, which are incorporated herein by reference.

A supplementary delivery of additional fiber is newly determined each time the spinning parameters are changed, for example after a batch change.

In the use customary in accordance with the prior art, the nominal draft $V_{NENN}$ and the average staple length $L_{ST}$, are used in a first statement for determining the supplementary delivery of additional fiber or the additional fiber length $L_A$, and the amount of fibers lacking is then taken into consideration in the form of a factor, for example as the combed-out portion $A_A$. The addition fiber length $L_{AE}$ as a function of the sliver then results from the equation:

$$L_{AE}=L_{ST}\times A_A$$

An empirical value for the combed-out portion $A_A$ is usually used to determine the amount of fibers lacking because of the fiber tuft combed out of the sliver. In accordance with experience, the staple length is shortened by approximately 20% by the combing-out process. At a staple length $L_{ST}$ of 25 mm,the theoretical supplementary length of additional fibers $L_{AE}$ to be taken into consideration results from the following:

$$L_{AE}=25\text{ mm}\times 0.2=5\text{ mm}.$$

Starting with the piecing, a measuring range between approximately 600 to 700 mm of yarn length following the piecing is normally monitored and used for determining a piecing profile which is evaluated, for example for monitoring the quality of the piecing.

Figure 2:
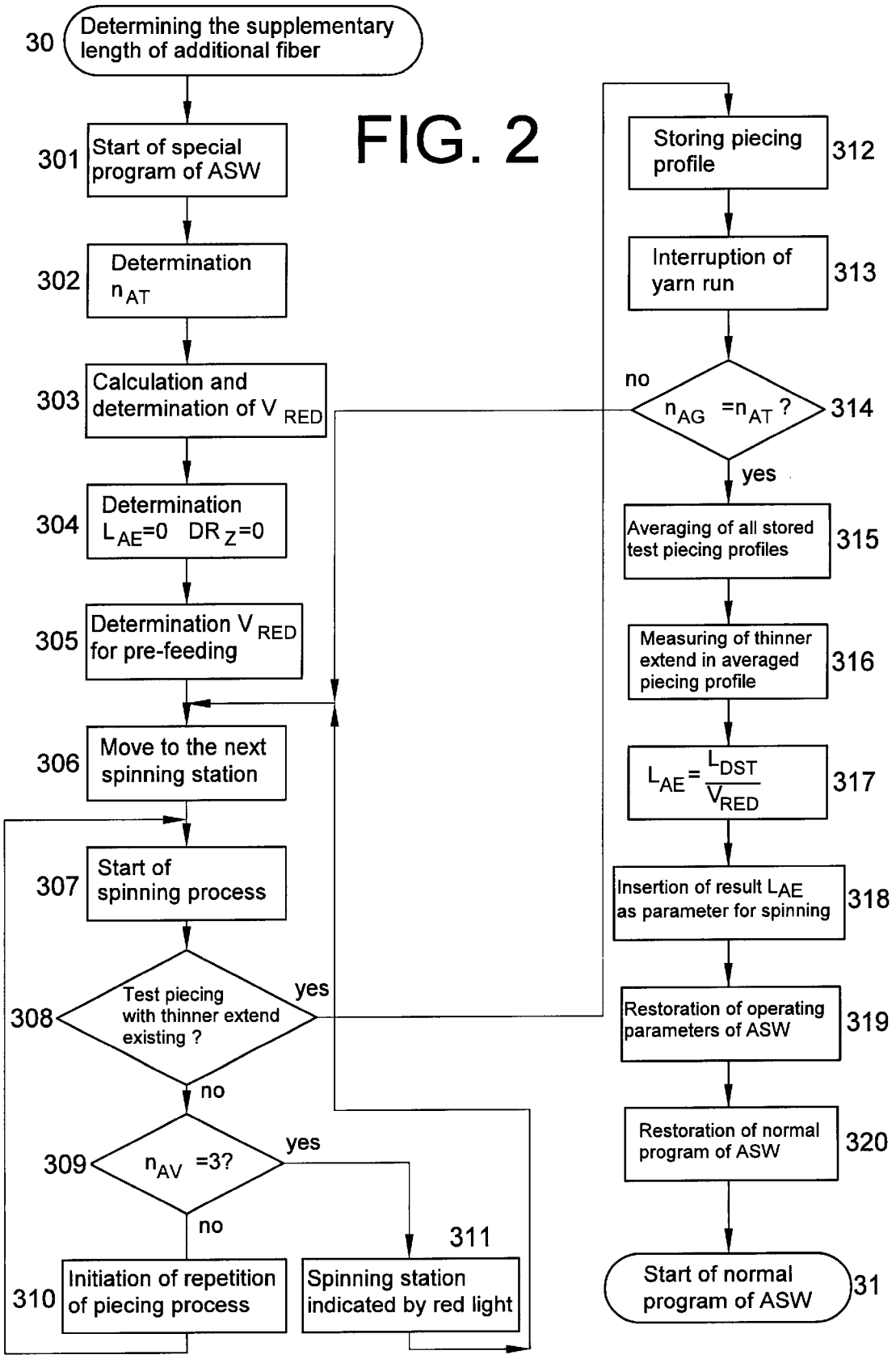
FIG. 2 is a schematic flow chart for determining the length of the supplementary delivery of additional fiber.

FIG. 2 shows a flow chart, in accordance with which a determination in accordance with the invention of the supplementary length can be performed. If the supplementary delivery of additional fiber must be newly determined, for example after a batch change or a change in the spinning parameters, a special program 30 is used.

Following the start 301 of the special program of the piecing cart (ASW), the determination 302 of the number of test piecings $n_{AT}$ is initially performed. Depending on the size of the nominal draft $V_{NENN}$ intended for the spinning operation, 15 to 50 test piecings should be created in the test phase. With an increasing draft, the number of test piecings $n_{AT}$ should also be increased. In the exemplary embodiment in FIG. 2, at a draft $V_{NENN}$ of 125, the number of the test piecings $n_{AT}$ is 22.

Thereafter, a calculation and determination 303 of a reduced draft $V_{RED}$ takes place in accordance with the algorithm $$V_{RED} = \frac{V_{MF} \times A_{MF}}{L_{ST} \times A_A}$$

wherein the staple length $L_{ST}$, the combed-out portion $A_A$, the length $L_{MF}$ of the measuring range for the test piecing (the so-called measuring window) and a proportionality factor $A_{MF}$ of the measuring range at the measuring window are added.

The draft $V_{RED}$ is determined by means of the proportionality factor $A_{MF}$, which here must lie below one, so as to assure that the thinner extent downstream of the test piecing is located completely within the measuring window and can be evaluated to its end.

With $L_{MF}$=600 mm $A_{MF}$=⅔

$L_{ST}$=20

$A_A$=20% the calculation by means of the above algorithm results in a draft of $$V_{RED} = \frac{600 \times 2 \times 5}{20 \times 3} = 100.$$

In the exemplary embodiment, this reduced draft $V_{RED}$ is determined for the test phase for creating test piecings. If the staple length is not known in this case, it need not be elaborately determined in the laboratory, but can be estimated. While an erroneous staple length leads to inadmissible errors in connection with a determination of the supplementary delivery of additional fiber length in accordance with the above described prior art, this is not the case when making the determination in accordance with the present invention.

Thereafter, the supplementary delivery of additional fiber length $L_A$ is set to zero at step 304. If the standard program for creating piecings contains an additional twist $DR_Z$, the latter is also set to zero. The determination at 305, or the activation, of the draft $V_{RED}$ for pre-feeding takes place. The creation of test piecings in accordance with the special program 30 can now be performed.

To create a test piecing, the piecing cart is moved to the next spinning station at which the start 307 of the piecing process takes place. Subsequently, a check 308 is performed to determine whether a test piecing is present. If the check 308 shows that there is no test piecing with a thinner extent 32, a check 309 is performed to determine whether the number of piecing attempts $n_{AV}$ at this spinning station equals 3. If this is not the case, a repetition of the piecing process is initiated at 310 by means of the start 307 of the piecing process at this spinning station.

If the check 309 leads to the result that the number of piecing attempts $n_{AV}$ equals 3, an alarm signal is triggered at 311 in that the respective spinning station is indicated by a red light. Thereafter, a move 306 to the next spinning station is performed.

If the check 308 determines that a test piecing 33 with a thinner extent 32 is present, the piecing profile is stored at 312 and an interruption 313 of the yarn run is performed.

Figure 3:
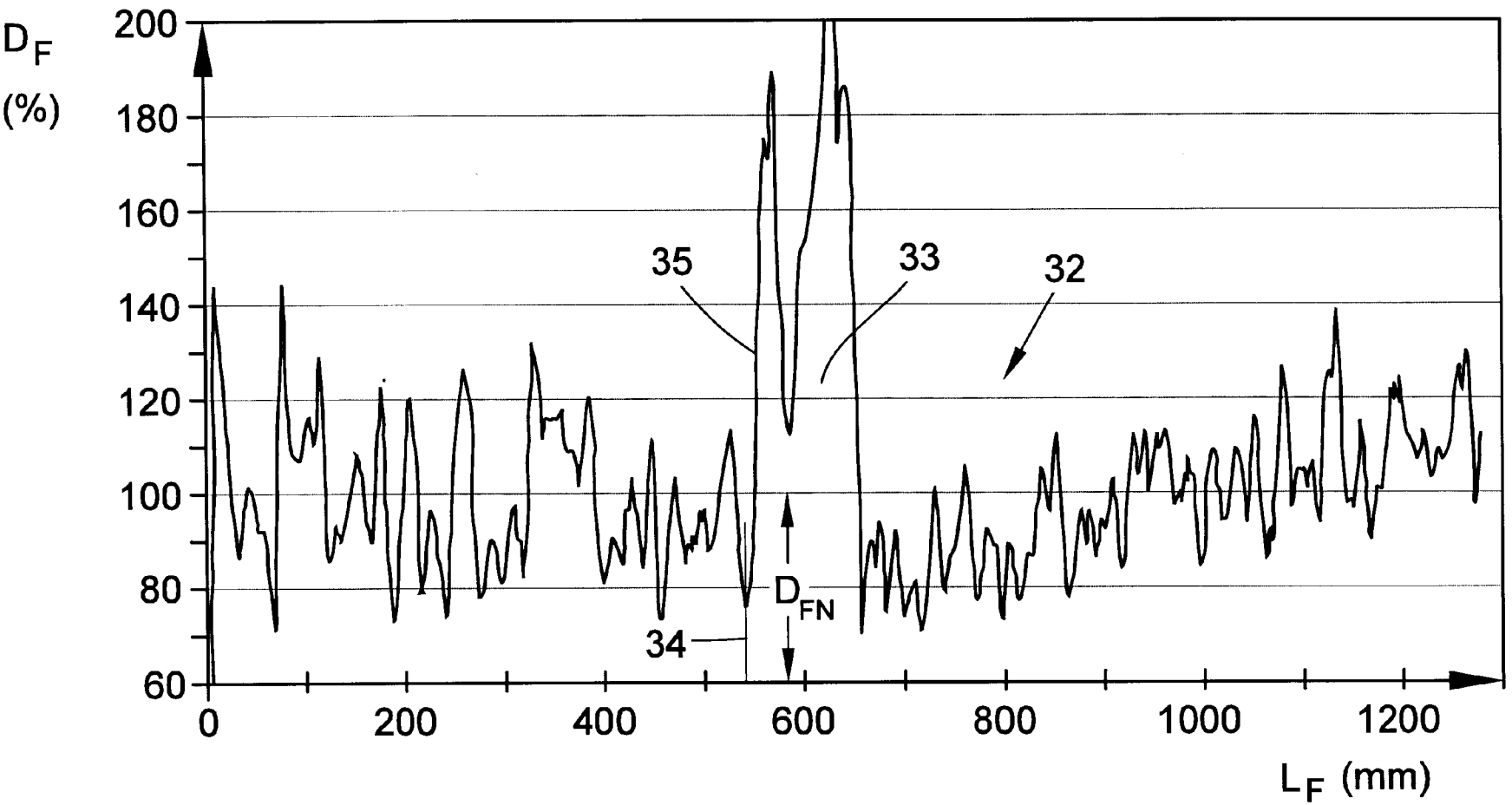
FIG. 3 is a graph which shows the profile of a single test piecing.

The piecing profile of an individual piecing 33 is represented in the form of a graph in FIG. 3, wherein the yarn diameter $D_F$ is represented as a function of the yarn length $L_F$. Here, the yarn diameter $D_F$ is related proportionately with respect to a standard yarn thickness $D_{FN}$ and is shown as a percentage of the standard yarn thickness $D_{FN}$. The thinner extent 32 downstream of the test piecing 33, in which the yarn diameter $D_F$ falls considerably below the standard yarn thickness $D_{FN}$, can be seen in FIG. 3. The start 34 of the test piecing 33 is distinguished by a short thinner extent before the steep rise 35 of the yarn diameter $D_F$ to the diameter of the test piecing 33.

Figure 4:
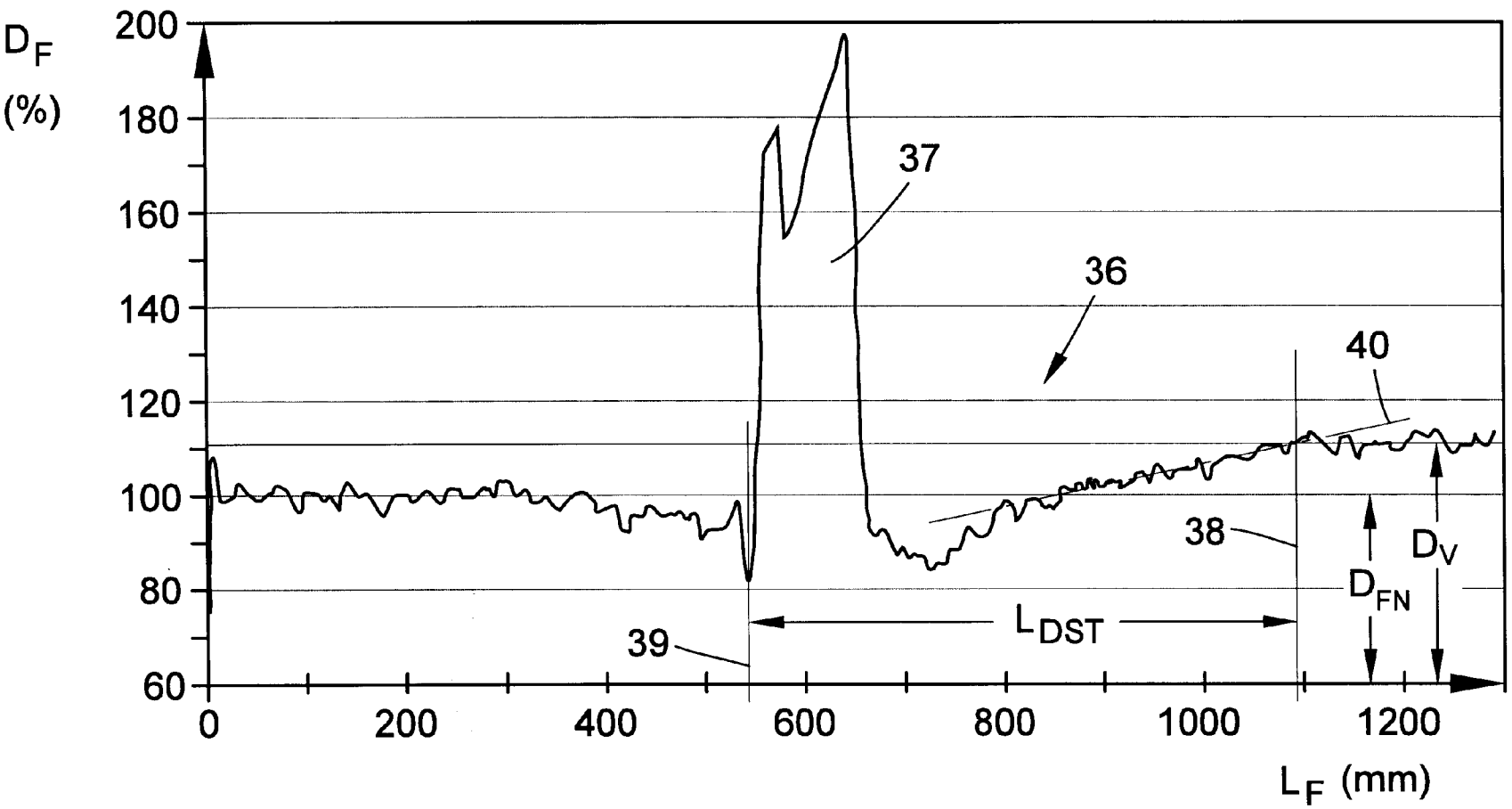
FIG. 4 is a graph which shows an averaged piecing profile obtained from a plurality of test piecings.

A check 314 to determine whether the total number $n_{AG}$ of the stored test piecings is equal to the preset number $n_{AT}$ of test piecings is performed thereafter. If the check 314 shows that $n_{AG}$ does not equals $n_{AT}$, a move 306 to the next spinning station takes place. If the check 314 shows that $n_{AG}$ equals $n_{AT}$, the averaging 315 of all stored test piecing profiles is performed. FIG. 4 is another graph which shows a piecing profile averaged in this way. In comparison with the graph in FIG. 3, the path of the graph in FIG. 4 is smoothed to a large degree and is therefore more easily accessible for evaluation. The thinner extent 36 in the averaged piecing profile downstream of the piecing 37 is distinctly visible in FIG. 4.

The measuring at 316 of the thinner extent 36 in the averaged piecing profile takes place thereafter. It is necessary in the course of measuring the thinner extent 36 at 316 to take into consideration that the standard yarn thickness $D_{FN}$ is based on an upper yarn end which has been created without the reduced draft $V_{RED}$ as the standard. Therefore the end 38 of the thinner extent 36 is distinguished by arriving at a comparison diameter $D_V$, which is greater than the standard yarn thickness $D_{FN}$.

The comparison diameter $D_V$ is a result of the equation $$D_V = D_{FN} \times F_{FN}.$$

$F_{FM}$ is a factor which is determined from the standard draft $V_{NENN}$, which obtains during normal spinning operation, and the reduced draft $V_{RED}$, and is determined as follows:

$$F_{FN} = \sqrt{\frac{V_{NENN}}{V_{RED}}}$$

For the exemplary embodiment in FIG. 4, the comparison diameter $D_V$ for determining the length $L_{DST}$ of the thinner extent 36 in the averaged piecing profile is determined to be $$D_V = D_{FN} \times \sqrt{125:100} = 1.118 \times D_{FN}.$$

Thus, the comparison diameter $D_V$ is 111.8% of the standard yarn thickness $D_{FN}$.

In the average piecing profile, the length $L_{DST}$ used for determining the supplementary length of additional fiber $L_{AE}$ is defined as the distance between the end 38 of the thinner extent 36 and the start 39 of the piecing 37. The start 39 of the piecing 37 is distinguished by a short thinner extent. The comparison diameter $D_V$, and therefore the end 38 of the thinner extent 36, have been reached when the path of the graph in the averaged piecing profile downstream of the piecing 37 again intersects the comparison diameter $D_V$, indicated by a horizontal line in FIG. 4, for the first time. Alternatively, the path of the curve, which is determined by means of the measured diameter values, can be represented, the averaged slope 40 of the path of the curve in the end area of the thinner extent 36 can be determined, and the intersection of the averaged slope 40, represented as a dash-dotted straight line, and the comparison diameter $D_V$, represented as a horizontal line, can be determined as the end point of the thinner extent 36. In the exemplary embodiment in FIG. 4, the length $L_{DST}$ between the start 39 of the piecing 37 and the end 38 of the thinner extent 36 at the intersection point is 544 mm.

The following now applies to the supplementary length of additional fiber $L_{AE}$ which must be taken into consideration when drawing the sliver in during normal spinning operations:

$$L_{AE} = \frac{L_{DST}}{V_{RED}}$$

With $L_{DST}$=544 mm $V_{RED}$=100 the result for the exemplary embodiment is $$L_{AE} = \frac{544}{100} = 5.44$$

The supplementary length of additional fiber $L_{AE}$ determined by means of the step 317 therefore is 5.44 mm.

In FIG. 2, step 318 indicates the insertion of the result of the determination of the supplementary length of additional fiber as a parameter for normal spinning operations. Subsequently a restoration 319 of operating parameters of the piecing cart, which had been changed for creating test piecings in the test phase, takes place, such as, for example, the parameter "draft", and after that the restoration 320 of the normal spinning program of the piecing cart for spinning operations. Now, the start 31 of the normal program of the piecing cart for normal spinning operations takes place.

In an alternative embodiment of the special program 30 for determining the supplementary length of additional fiber, not represented, triggering 311 of a red light alarm signal at the spinning stations takes place only if no test piecing can be produced.

In a further alternative embodiment of the program 30, also not represented, initiation 310 of the repetition of the piecing process, or triggering 311 of the red light alarm signal no longer takes place following the interruption 313 of the yarn run, and instead the respective movement of the piecing cart to the next spinning station is performed. By means of these two alternative embodiments of the program 30 it is possible to avoid the triggering 311 of a red light which, in the above cases, has been classified as unnecessary and would need to be manually cancelled by the operator. The creation of test piecings can be extended to as many spinning stations as possible.

Figure 5:
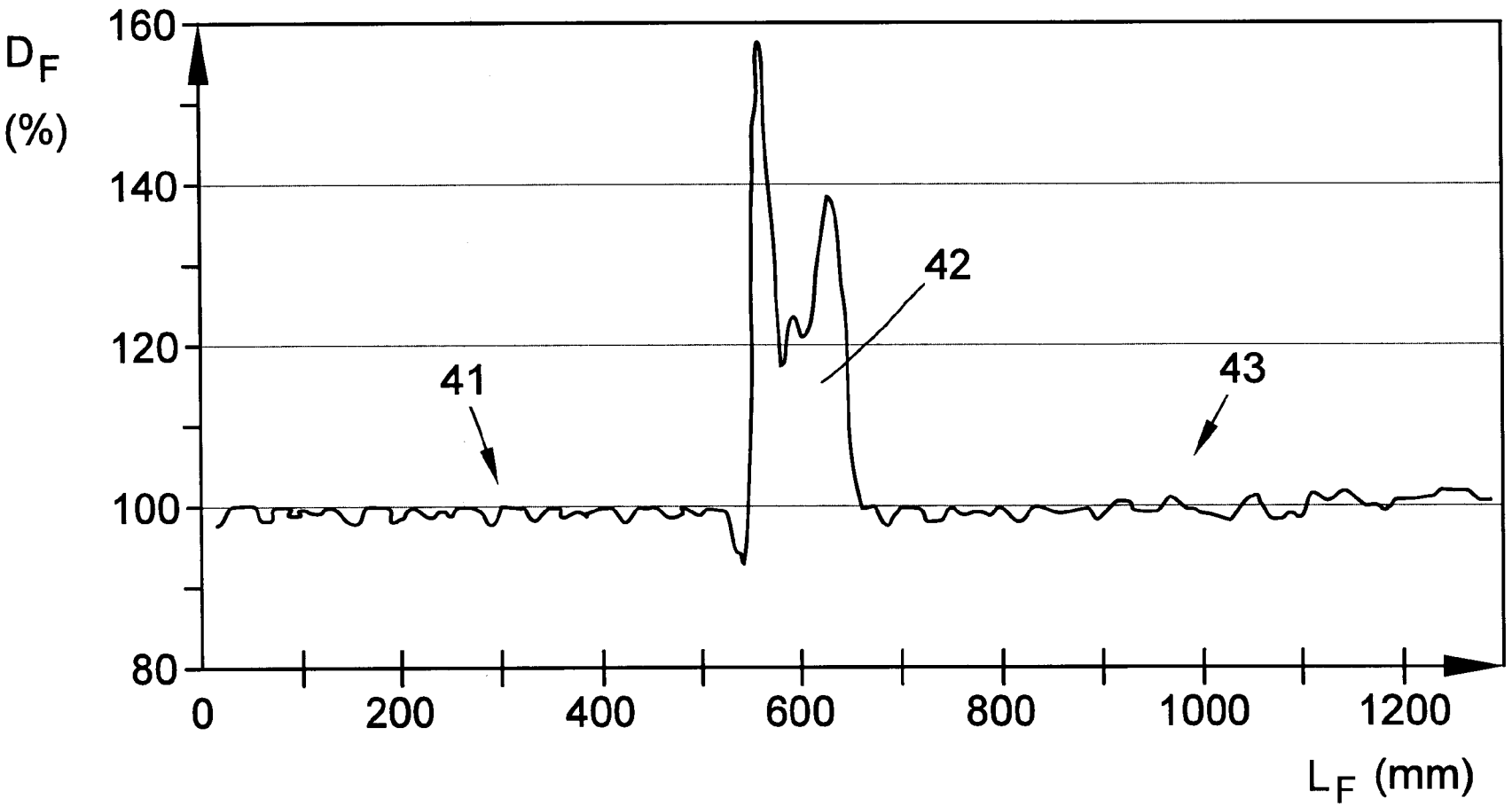
FIG. 5 is a graph which shows an averaged piecing profile of piecings with the determination in accordance with the invention of the supplementary delivery of additional fiber.

FIG. 5 represents an averaged piecing profile from 120 piecings, wherein the optimization of the delivery length has been performed in accordance with the invention. An excellent agreement between the diameters in the area 41 of the upper yarn and the diameter of the yarn section 43, which was freshly spun adjoining the piecing 42, can be seen.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A yarn piecing device, comprising an evaluation arrangement for determining parameters of an automatic piecing process, at least one sensor device for measuring yarn diameter and for detecting a location of a measuring point in respect to a yarn piecing, a control device operable initially in a test phase for controlling formation of at least one test piecing and controlling subsequent removal of the created test piecing prior to a supplementary delivery of additional fiber, means for determining the length of a thinner extent of the yarn downstream of the test piecing, and means for determining from the detected length of the thinner extent an amount of supplementary delivery of additional fiber required for compensating the thinner extent.

2. The piecing device in accordance with claim 1, characterized in that the control device is operable for controlling a reduction in drafting of the yarn during the test phase.

3. The piecing device in accordance with claim 1, characterized in that a profile of the thinner extent is formed from determining an average value from a plurality of test piecings.

4. The piecing device in accordance with claim 3, characterized in that the number of the test piecings used for forming the average value increases with an increased drafting of the yarn.

5. The piecing device in accordance with claim 3, characterized further by a device for displaying the piecing profile.

6. A yarn piecing device, comprising an evaluation arrangement for determining parameters of an automatic piecing process, at least one sensor device for measuring yarn diameter and for detecting a location of a measuring point in respect to a yarn piecing, a control device operable in a test phase for controlling formation of at least one test piecing without a supplementary delivery of additional fiber and controlling subsequent removal of the created test piecing, means for determining the length of a thinner extent of the yarn downstream of the test piecing, and means for determining from the detected length of the thinner extent an amount of supplementary delivery of additional fiber required for compensating the thinner extent, wherein the control device is operable for controlling a reduction in drafting of the yarn during the test phase and for determining the size of the draft reduction by means of an algorithm which takes into consideration a staple length and a limited measuring range for measuring the yarn diameter.

7. A yarn piecing device, comprising an evaluation arrangement for determining parameters of an automatic piecing process, at least one sensor device for measuring yarn diameter and for detecting a location of a measuring point in respect to a yarn piecing, a control device operable in a test phase for controlling formation of at least one test piecing without a supplementary delivery of additional fiber and controlling subsequent removal of the created test piecing, means for determining the length of a thinner extent of the yarn downstream of the test piecing, and means for determining from the detected length of the thinner extent an amount of supplementary delivery of additional fiber required for compensating the thinner extent, wherein the control device is operable for controlling a reduction in drafting of the yarn during the test phase and the draft during the test phase is determined by multiplying a nominal draft with a predetermined factor.

* * * * *